US011788771B2

(12) United States Patent
Phillips et al.

(10) Patent No.: US 11,788,771 B2
(45) Date of Patent: Oct. 17, 2023

(54) SACRIFICAL ANODE CONTROL FOR A WATER HEATER

(71) Applicant: A. O. SMITH CORPORATION, Milwaukee, WI (US)

(72) Inventors: Andrew William Phillips, Scottsdale, AZ (US); Christopher Glynne Townsend, Chandler, AZ (US); Ray O. Knoeppel, Hartland, WI (US); Brian T. Branecky, Oconomowoc, WI (US); Kedar D. Dimble, Milwaukee, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 211 days.

(21) Appl. No.: 17/324,711

(22) Filed: May 19, 2021

(65) Prior Publication Data

US 2022/0373225 A1 Nov. 24, 2022

(51) Int. Cl.
*F24H 9/45* (2022.01)

(52) U.S. Cl.
CPC ..... *F24H 9/45* (2022.01)

(58) Field of Classification Search
CPC . F24H 9/0047; F24H 9/40; F24H 9/45; F24H 9/455
See application file for complete search history.

(56) References Cited

U.S. PATENT DOCUMENTS

| | | | | |
|---|---|---|---|---|
| 4,306,189 | A | 12/1981 | Nozaki | |
| 4,407,711 | A * | 10/1983 | Baboian | F24H 9/45 204/196.02 |
| 4,975,560 | A * | 12/1990 | Wardy | F24H 9/45 204/196.05 |
| 5,256,267 | A * | 10/1993 | Roden | C23F 13/10 138/DIG. 6 |
| 7,585,397 | B2 * | 9/2009 | Bollinger | C23F 13/04 205/730 |
| 2006/0083491 | A1 | 4/2006 | Knoeppel et al. | |
| 2014/0262822 | A1 * | 9/2014 | Knoeppel | C23F 13/04 204/196.03 |
| 2014/0376899 | A1 | 12/2014 | Boros et al. | |
| 2018/0128514 | A1 | 5/2018 | Knoeppel et al. | |

FOREIGN PATENT DOCUMENTS

EP 3683519 A 7/2020

* cited by examiner

*Primary Examiner* — Gregory A Wilson
(74) *Attorney, Agent, or Firm* — Michael Best & Friedrich LLP

(57) ABSTRACT

A water heater includes a tank configured to hold a fluid, a sacrificial anode located within the tank, and a controller coupled to the sacrificial anode. The controller is configured to selectively complete and break an electrical circuit connecting the tank and the sacrificial anode. The controller is also configured to measure a shorted anode current through the electrical circuit, to determine a modulation duty cycle based on a current setpoint and the measured shorted anode current, and to repeatedly complete and break the electrical circuit using the modulation duty cycle.

19 Claims, 5 Drawing Sheets

SACRIFICAL ANODE CONTROL FOR A WATER HEATER

FIELD

Embodiments relate to tank-based water heating systems including an anode, and more specifically, a sacrificial anode.

BACKGROUND

Water heater tanks may be made of metal, which can react with water stored within the tank, resulting in corrosion of the metal and, eventually, failure of the tank. Mechanisms for limiting corrosion may include lining the tank with a non-corrosive material such as glass. Some water heating systems also include a sacrificial anode to inhibit corrosion of the tank material. The combination of the sacrificial anode, the metal tank, and the water create a galvanic cell, wherein an oxidation reaction is concentrated at the sacrificial anode and a reduction reaction is concentrated at the metal tank, causing a current to flow through the anode and the tank. When the resulting current is sufficiently high, the oxidation reaction is sufficiently concentrated at the anode to effectively prevent corrosion of the metal tank material.

The oxidation reaction at the sacrificial anode will over time consume the anode. As the current flow resulting from the galvanic cell increases, the rate at which the anode is consumed also increases. Once the anode is fully consumed, the metal tank wall will no longer be protected and will corrode, which eventually leads to structural failure of the water heater. In order to extend the lifetime of the water heater, it is therefore desirable to not have the anode current be greater than that which is necessary to sufficiently concentrate the oxidation reaction at the anode.

In certain situations, such as when the water in the tank has a high conductivity, the resulting anode current will be in excess of what is necessary to adequately protect the tank. Some methods for restricting the anode current in such situations are known, but they typically require an external power source (for example, a power outlet) in order to operate. However, many water heater tanks, particularly those that are gas-based, do not include an electric power source, making such methods problematic to implement.

SUMMARY

One embodiment provides a water heater that includes a tank configured to hold a fluid, a sacrificial anode located within the tank, and a controller coupled to the sacrificial anode. The controller is configured to selectively complete and break an electrical circuit connecting the tank and the sacrificial anode. The controller is also configured to measure a shorted anode current through the electrical circuit, to determine a modulation duty cycle based on a current setpoint and the measured shorted anode current, and to repeatedly complete and break the electrical circuit using the modulation duty cycle.

In at least some embodiments the controller includes one or more switches, such as transistors or the like. In some embodiments the controller is configured to complete and break the electrical circuit by closing and opening one such switch. In some such embodiments the controller includes a resistor arranged in series with the switch, and the controller is configured to measure the shorted anode current by measuring a voltage drop across the resistor.

In at least some embodiments, the controller includes two switches that are arranged electrically in parallel. In some such embodiments, one switch is arranged to repeatedly complete and break the electrical circuit in response to commands from the controller, and the other switch is in a closed configuration in the absence of power being supplied to the controller and is in an open configuration while power is supplied to the controller.

In some embodiments, the controller is further configured to measure the shorted anode current at a set frequency. In some embodiments the set frequency is weekly, but in other embodiments the set frequency is more often or less often. In some embodiments, the modulation duty cycle is adjusted based on each measurement of the shorted anode current. In some embodiments, the controller is configured to complete and break the electrical circuit using pulse width modulation at a frequency of at least 1 kHz. In some embodiments, the pulse width modulated frequency is between approximately 30 kHz and 140 kHz. In still other embodiments, the pulse width modulation frequency is less than 1 kHz. In still other embodiments, modulation other than pulse width modulation is used.

In some embodiments, the controller includes a power source. In some such embodiments, the power source includes a battery. In some embodiments, the power source includes multiple batteries. The power source can alternatively be provided by other means, such as a wall power adapter, a thermo-electric generator, a capacitor (such as a super capacitor), or a solar panel, or even by the galvanic cell created by the sacrificial anode and the tank. In some embodiments, the controller includes one or more batteries that are recharged by an alternative power source such as a wall power adapter, a thermo-electric generator, a solar panel, or the galvanic cell.

Another embodiment provides a method for controlling a sacrificial anode for a tank containing an electrolytic fluid, such as water. The method includes measuring a shorted anode current through the sacrificial anode and the tank, determining a modulation duty cycle, and completing and breaking an electrical circuit connecting the sacrificial anode and the tank using the modulation duty cycle. In some such embodiments the modulation duty cycle is based on a current setpoint and the measured shorted anode current. In some embodiments, measuring the shorted anode current includes turning on a switch in order to complete the electrical circuit and measuring a voltage drop across a resistor arranged in series with the switch.

In some embodiments, the method includes measuring the shorted anode current at a set frequency. In some embodiments the set frequency is weekly, but in other embodiments the set frequency is more often or less often. In some embodiments, the modulation duty cycle is adjusted based on each measurement of the shorted anode current. In some embodiments, the controller is configured to complete and break the electrical circuit using pulse width modulation at a frequency of at least 1 kHz. In some embodiments, the pulse width modulated frequency is between approximately 30 kHz and 140 kHz. In still other embodiments, the pulse width modulation frequency is less than 1 kHz. In still other embodiments, modulation other than pulse width modulation is used.

In some embodiments, the modulation duty cycle is determined such that an integral over a period of time of the current flow resulting from making and breaking the electrical circuit connecting the sacrificial anode and the tank using the modulation duty cycle is equivalent to the current setpoint multiplied by said period of time.

In some embodiments, the method includes operating, in response to the power source discharging below a power threshold, a switch to a closed position, wherein an electrical short is present between the sacrificial anode and the tank when the switch is in the closed position. In some embodiments, the switch is a transistor.

According to another embodiment of the application, a method for controlling a sacrificial anode for a tank containing an electrolytic fluid includes operating in a first mode when power is available to a controller for the sacrificial anode and in a second mode when power is not available to the controller. In some such embodiments, operating in the first mode includes selectively opening and closing a first switch to regulate an average current flow between the sacrificial anode and the tank. In at least some such embodiments, operating in the first mode requires no more than 30 mA of average current draw by the controller. In some embodiments, operating in the second mode includes allowing a second switch to close in order to allow a constant current flow between the sacrificial anode and the tank.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
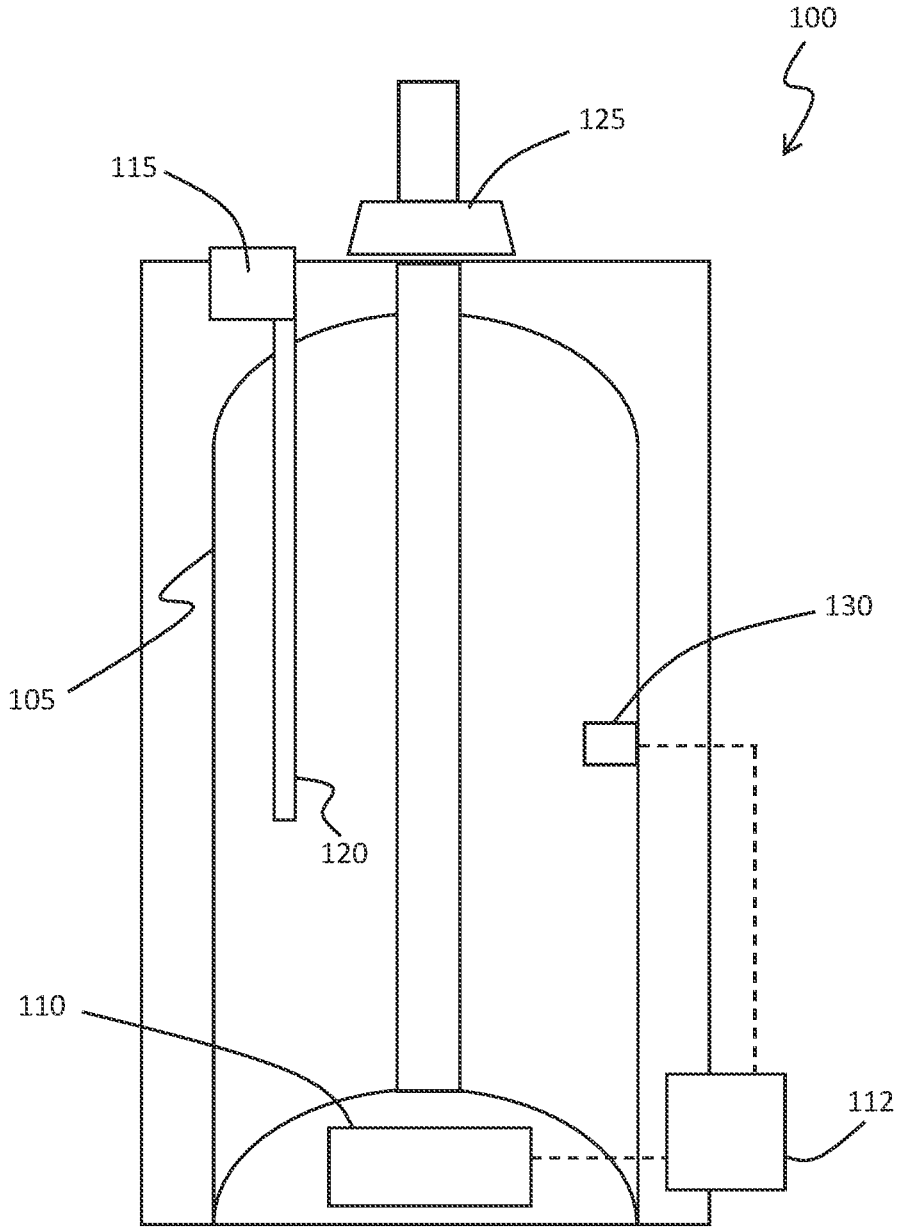
FIG. 1 is a block diagram of a water heater according to some embodiments.

FIG. 1 illustrates a water heater 100 according to some embodiments. The water heater 100 includes a tank 105 and a source of heat arranged within, or in close proximity to, the tank 105. In the illustrated embodiment the heat source is a burner assembly 110, but in alternative embodiments the heat source may take other forms such as, for example, a condenser coil of a heat pump system. The tank 105 is constructed of a metallic material (for example, steel) that is preferably lined with glass on inner surfaces, and is configured to hold a fluid (such as, but not limited to, water). The burner assembly 110 is configured to provide heat to the fluid within the tank 105 via combustion performed by a burner. In the illustrated embodiment, the burner assembly 110 is configured to receive combustion gas (for example, via a gas line) and air. The air and gas are combined within the burner assembly 110 and are subsequently combusted by the burner. The burner assembly 110 may include additional components (for example, thermocouple(s), control valves, etc.) for operation of the burner assembly 110. Furthermore, the tank 105 may include an exhaust assembly 125 to direct exhaust (resulting from the combustion performed by the burner assembly 110) outside of the water heating system 100.

A controller 112 operates the burner assembly 110 to heat and/or maintain the fluid in the tank 105 to a desired temperature. The controller 112 may determine the current temperature of the fluid in the tank 105 based on signals received from one or more temperature sensor(s) 130 located on or proximate the tank 105. In at least some embodiments the controller 112 is powered by the burner assembly 110, such as by a thermopile that converts heat from a standing pilot flame in the burner assembly 110 to electrical energy.

The water heating system 100 also includes a sacrificial anode 120 positioned within the tank 105. The sacrificial anode 120 provides galvanic protection of the metal tank 105 in order to prevent or substantially slow a rate at which the metal surfaces that come into contact with the contents of the tank (e.g., water) corrode. To that end, the sacrificial anode 120 is constructed of a material that has a more reactive electrode potential than the material of the metal tank. For example, the sacrificial anode can be constructed of magnesium or aluminum alloys and the tank can be constructed of steel. When the tank is filled with an electrolyte such as water, an electrochemical cell is formed between the sacrificial anode 120 and the tank 105. The sacrificial anode 120 will function as the anode of the electrochemical cell and the tank 105 will function as the cathode, thus providing cathodic protection of the tank 105.

The water heater 100 further includes a controller 115 for the sacrificial anode 120. As will be described, the controller 115 can be configured to selectively provide an electrical connection between the sacrificial anode 120 and the metal tank 105 in order to complete the circuit that forms the aforementioned electrochemical cell between the metal tank 105 and the sacrificial anode 120.

Figure 2:
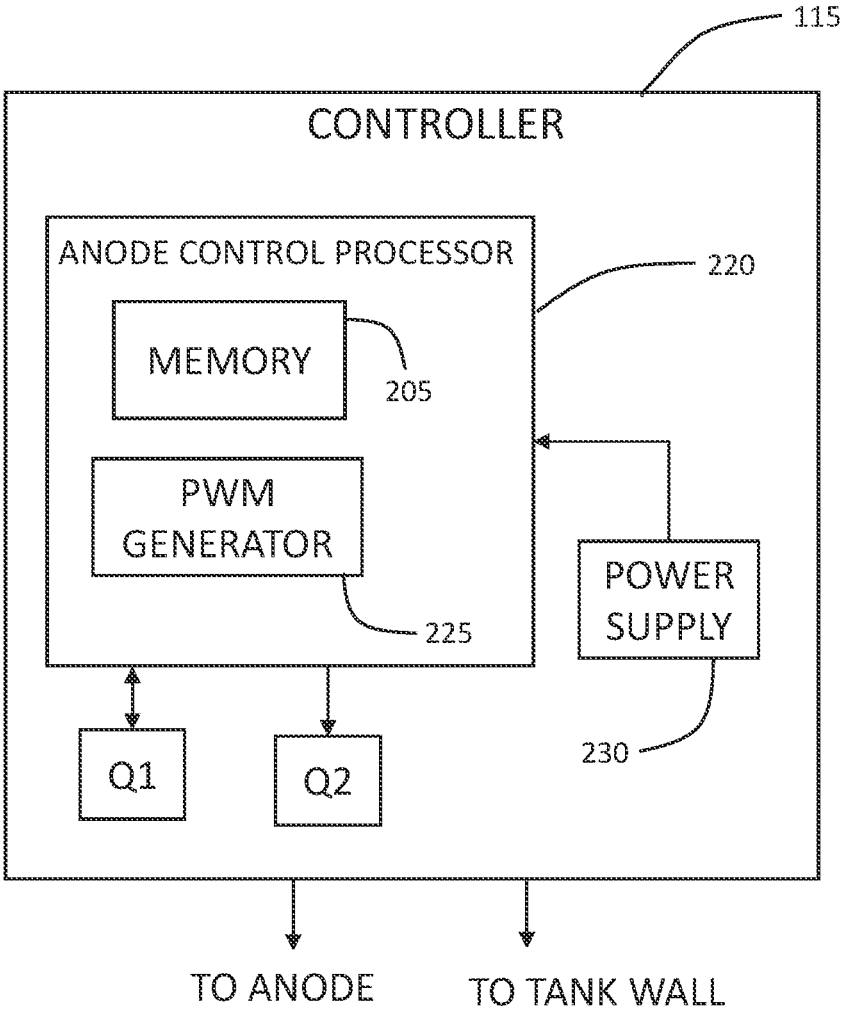
FIG. 2 is a block diagram of an anode controller for the water heater of FIG. 1 according to some embodiments.

FIG. 2 illustrates the controller 115 in further detail according to some embodiments. The controller 115 includes a combination of hardware and software components. The controller 115 includes a printed circuit board ("PCB") that is populated with a plurality of electrical and electronic components that provide power and operational control to control the operation of the sacrificial anode 120. In the example of FIG. 2, the PCB includes an electronic processor, or anode control processor, 220 (e.g., a microprocessor, a microcontroller, or another suitable programmable device or combination of programmable devices). The processor 220 includes a memory 205. The memory 205 includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The electronic processor 220 executes software instructions that are capable of being stored in the memory 205. Additionally, or alternatively, the memory 205 can be provided as a separate component from the electronic processor 220 on the PCB. Software included in the implementation of the galvanic protection of the water heater 100 is stored in the memory 205 of the controller 115. The software includes, for example, firmware, one or more applications, program data, one or more program modules, and other executable instructions. The controller 115 is configured to retrieve from memory 205 and execute, among other things, instructions related to the control processes and methods described herein.

The controller 115 receives power from a power supply (e.g., a power source) 230. As depicted in FIG. 2, the power supply can be incorporated directly into the controller 115, but in some alternative embodiments the power supply 230 is separate from the controller 115 and is connected thereto. The power supply 230 can be, for example, a battery source (AA batteries, AAA batteries, etc.). In other embodiments, the power supply 230 can be provided by other energy sources such as solar panels, thermo-electric generators (TEG), a wall power adapter, or the galvanic potential between the metal tank 105 and the sacrificial anode 120. In some embodiments, a thermopile (for example, a thermopile of the burner assembly 110) is used to provide power to the power supply 230 (for example, in order to recharge the power supply 230). In such an embodiment, the thermopile may be located proximate to a flame generated by the burner assembly 110 and convert thermal energy to electrical energy. In at least some such embodiments, the controller 115 and the water heater controller 112 both derive power from the same power supply 230. In still other embodiments, a TEG coupled to the exhaust assembly 125 is used to convert waste heat from the combustion exhaust into electrical energy to provide power to the power supply 230 (for example, in order to recharge the power supply 230).

The PCB of the controller 115 also includes, among other things, a plurality of additional passive and active components such as resistors, capacitors, diodes, integrated circuits, and the like. These components are arranged and connected to provide a plurality of electrical functions to the PCB. For descriptive purposes, the PCB and the electrical components populated on the PCB are collectively referred to herein as the controller 115.

The controller 115 operates an anode control processor 220 to regulate the current flow between the sacrificial anode 120 and the tank 105. In some embodiments, the anode control processor 220 includes a pulse-width modulator (PWM) generator 225 to allow for a PWM current flow between the sacrificial anode 120 and the tank 105. The PWM generator 225 can be directly incorporated into the anode control processor 220, as shown in FIG. 2, or can be defined by one or more additional components of the controller 115.

Figure 3:
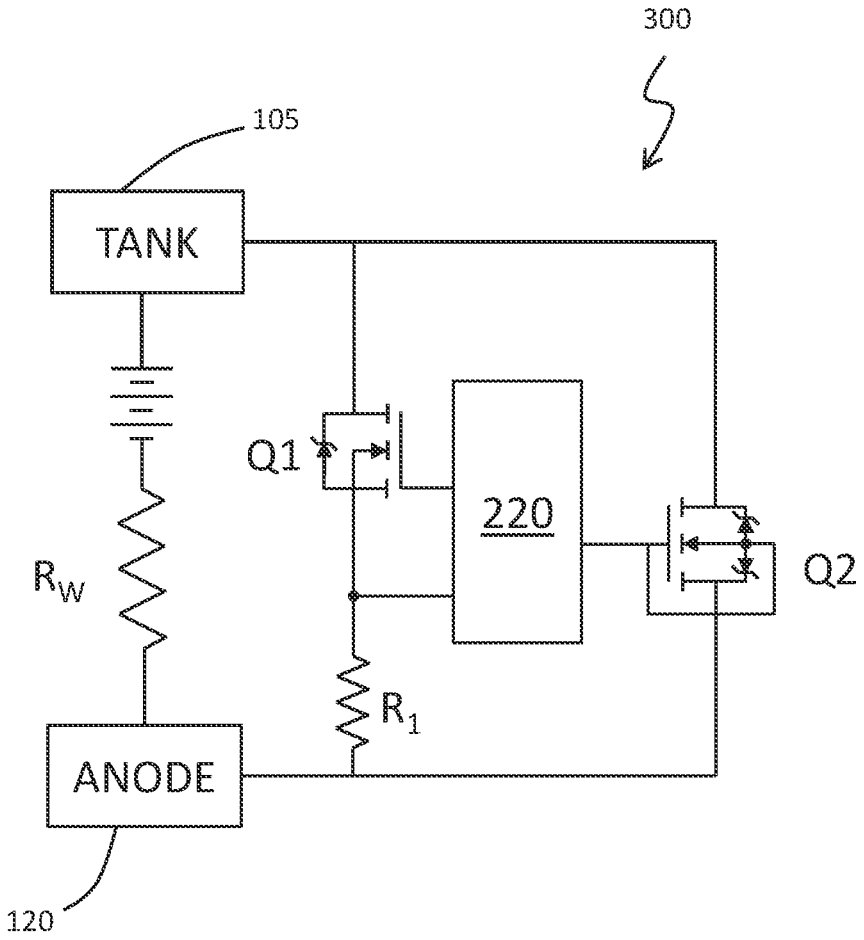
FIG. 3 is a simplified circuit diagram of an anode control circuit for the water heater of FIG. 1 according to some embodiments.

FIG. 3 provides a simplified circuit diagram of an anode control circuit 300 including the anode control processor 220, according to one embodiment. The anode control circuit 300 further includes a first switch Q1 and a second switch Q2, either of which is capable of completing the electrical circuit between the sacrificial anode 120 and the tank 105. The plurality of switches Q1 and Q2 may each be, for example, a transistor, a MOSFET, or the like. In the exemplary embodiment of FIG. 3, the first switch Q1 is depicted as an enhancement mode MOSFET and the second switch Q2 is depicted as a depletion mode MOSFET, but in alternative embodiments other types of switches may be used. The first switch Q1 connects the sacrificial anode 120 to the electronic processor 220 such that a PWM signal can be provided to the sacrificial anode 120, as described below in more detail. Meanwhile, the second switch Q2 may connect the anode 120 directly to the wall of the tank 105. Although illustrated as having two switches, in other embodiments the anode control circuit 300 may include more or fewer switches.

The sacrificial anode 120 and the tank 105 can form a circuit through which current flows when a suitable electrolyte (for example, water) is in the tank and in contact with both the sacrificial anode 120 and the wall of the tank 105. The presence of the electrolyte, in combination with the construction materials of the anode 120 and the tank 105 having different electrochemical potential, forms an electrochemical cell. The completion of such a circuit requires an electrical connection (other than through the electrolyte) between the sacrificial anode 120 and the tank 105. When such an electrical connection between the anode 120 and the tank 105 is completed, the resulting current through the electrolyte is referred to as the shorted anode current. This current is the result of oxidation occurring more preferentially at the surface of the anode 120 and reduction occurring more preferentially at the surface of the tank 105 (the cathode of the circuit), with the electrons produced by the oxidation reaction at the anode 120 traveling through the electrical connection to support the reduction reaction at the cathode.

The shorted anode current is dependent upon the conductivity of the water in the tank 105, which is influenced by dissolved minerals in the water, a pH level of the water, and the water temperature. High conductivity water will result in a high shorted current, while low conductivity water will result in a low shorted current. Water conductivity is strongly influenced by the presence and concentrations of dissolved minerals within the water, and can vary widely between different installations of water heater. In installations where the water has a high conductivity, the resulting shorted current can be, for example, as high as 50 mA. Conversely, in installations where the water has a very low conductivity, the resulting shorted current can be, for example, as low as 2 mA. The electrical resistance in the completed circuit resulting from the water conductivity is represented in FIG. 3 as resistor $R_W$.

As the current flow through the completed anode circuit increases, the rate at which the anode material is consumed by the oxidation reaction will likewise increase. Once the anode material is fully consumed, the protective circuit will cease to exist, and the tank 105 will no longer be protected from corrosion. Once the tank is no longer protected from corrosion, failure of the water heater will be imminent. Thus, it is advantageous to limit the current flow to be no greater than the amount necessary to protect the tank 105 from oxidation, since a current flow above this amount will not provide any additional benefit and will only serve to shorten the expected life of the tank. The inventors have found that a current of 8 mA is typically sufficient to provide such protection. As noted above, the shorted anode current in installations where the water has a high conductivity can be significantly higher.

Figure 4:
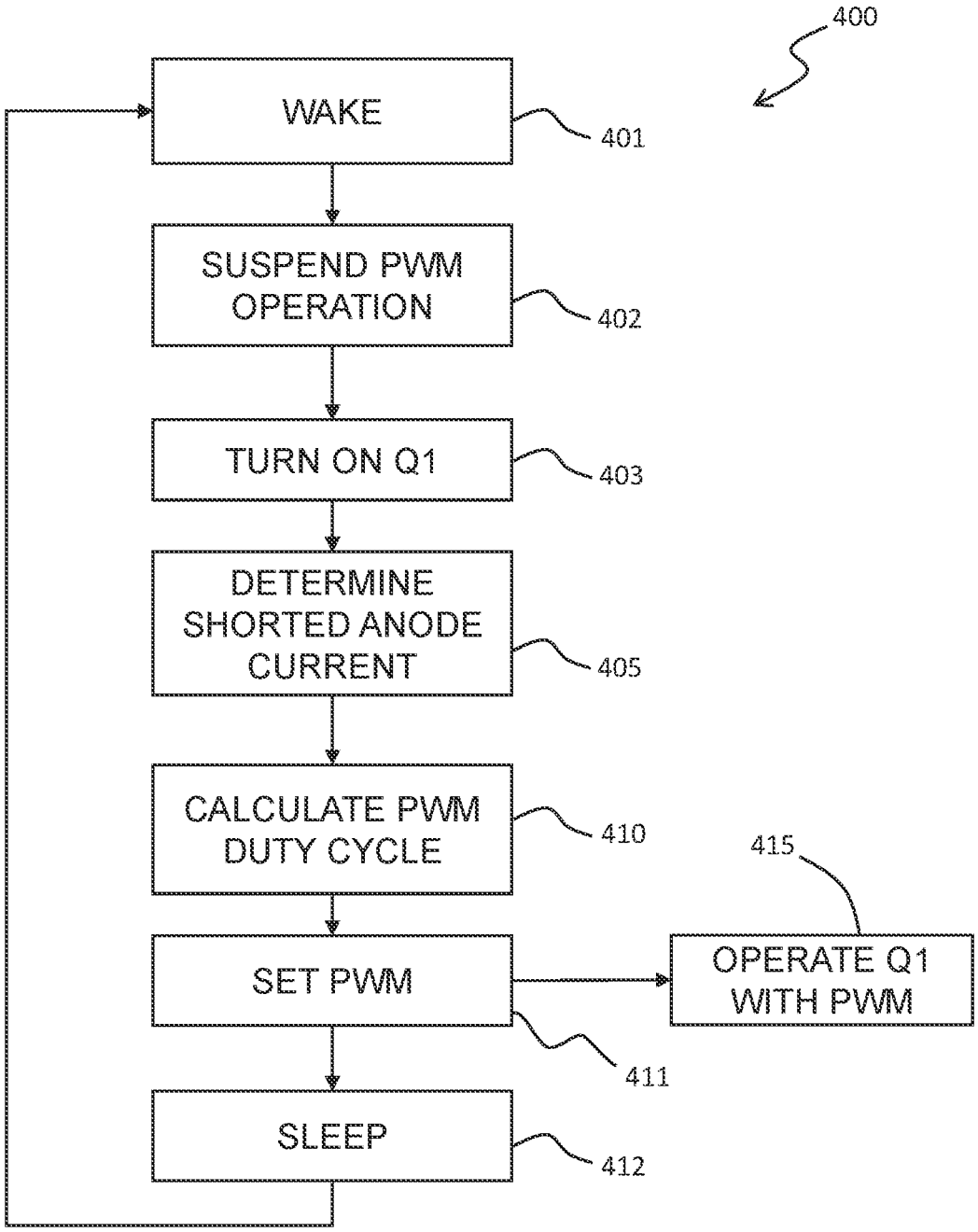
FIG. 4 is a block diagram of a method performed by the controller of FIG. 2 according to some embodiments.

The controller 115 is configured to control the current of the sacrificial anode 120 in order to improve the life expectancy of the sacrificial anode 120, and thus the tank 105 and the water heater 100. FIG. 4 provides a method 400 performed by the controller 115 for controlling the current of the sacrificial anode 120 according to some embodiments. It should be understood that the order of the steps/blocks disclosed in method 400 may vary. Furthermore, additional steps/blocks may be added to the process and not all of the steps may be required.

At block 401, the processor 220 wakes from a sleep mode during which power consumption is minimized. At block 402, the processor 220 suspends any PWM operation that was ongoing during the sleep mode. At block 403, the processor 220 activates the gate of the switch Q1, thereby completing the electrical circuit between the anode 120 and the tank 105 (assuming that there is water in the tank 105 to act as the electrolyte). The processor 220 maintains the switch Q1 in the closed position for a period of time, for example thirty seconds. During that period of time, the processor 220 measures a voltage drop across the resistor $R_1$, which is located on the PCB of the controller 115. This is then used by the controller to determine the shorted anode current (block 405). The resistance value of resistor $R_1$ is preferably selected to be substantially less than the expected resistance of the water $R_W$ (so that it does not contribute significantly to the overall resistance within the circuit) but is selected to be high enough to allow for a reasonably accurate determination of the shorted anode current. In at least one embodiment, the resistance of $R_1$ is selected to be around five Ohms.

Once the shorted anode current ($I_{SHORT}$) has been determined, the processor 220 calculates a duty cycle for the pulse width modulation (block 410). The duty cycle may be calculated as the inverse of a ratio between $I_{SHORT}$ and a predetermined setpoint current ($I_{SET}$). The value of $I_{SET}$ is preferably a minimum current that is expected to provide sufficient protection for the tank 105. This value can be pre-programmed into the memory 205, or can be set by a user such as a customer, homeowner, installer, service personnel, etc. In at least some embodiments, $I_{SET}$ is a preprogrammed value in the range of 6 mA to 10 mA, and in some particular embodiments is preprogrammed to be about 8 mA. As an example, with a setpoint current ($I_{SET}$) of 8 mA and a shorted anode current ($I_{SHORT}$) of 40 mA, the duty cycle can be calculated as ($I_{SET}/I_{SHORT}$), resulting in a duty cycle of 20%. Once the desired duty cycle is calculated in block 410, the controller (in block 411) sets the PWM generator 225 to cycle the switch Q1 at the calculated duty cycle.

Figure 5:
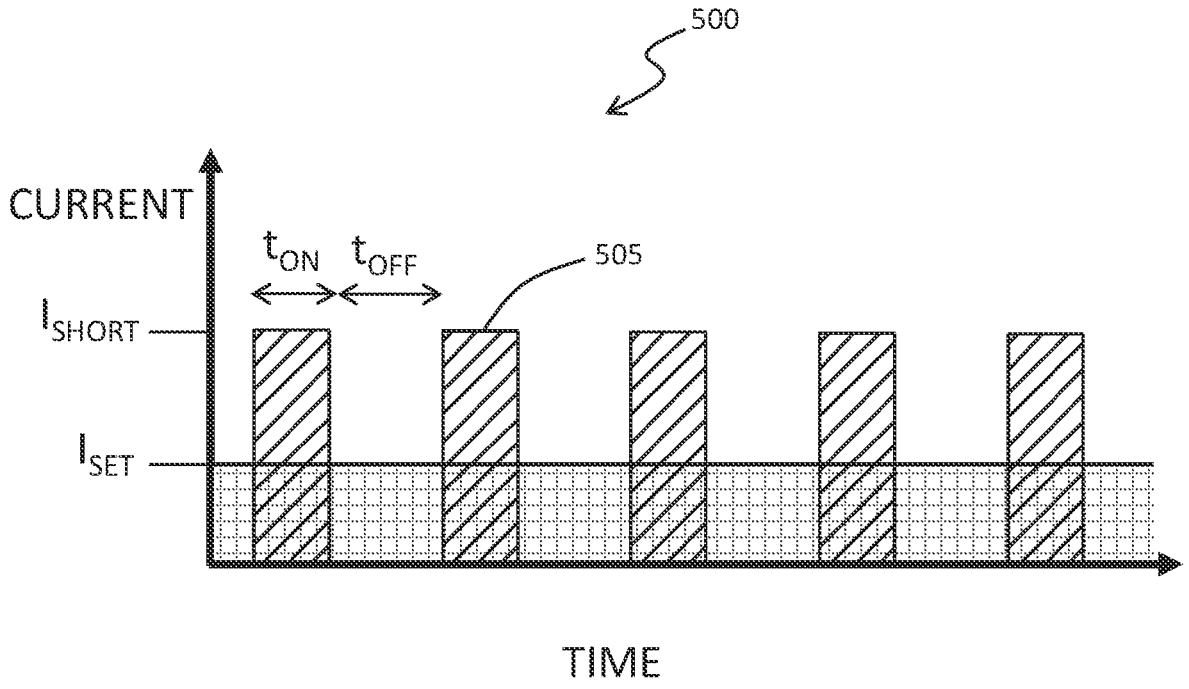
FIG. 5 is a graph illustrating an exemplary pulse width modulated current flow according to some embodiments.

In block 415, the PWM generator operates the switch at a high frequency using the calculated duty cycle. The frequency is preferably at least 1 kHz, and in some particular embodiments the frequency is in the range of 30 kHz-140 kHz. As seen in FIG. 5, the resulting current flow through the anode-tank circuit is a pulse wave 505 with a magnitude equal to $I_{SHORT}$ and a period equal to the inverse of the switching frequency. During a time $t_{ON}$ of each period the switch Q1 is closed and the current through the circuit is equal to $I_{SHORT}$, and during the remaining time of each period $t_{OFF}$ the switch Q1 is open and there is no current flow through the circuit. The time duration $t_{ON}$, as a percentage of the cycle period ($t_{ON}$ plus $t_{OFF}$) is equal to the PWM duty cycle. As a result, the integral of the current flow over time (i.e. the area under the curve 505, indicated with diagonal hatching in the graph of FIG. 5) is equivalent to the integral of a constant current at the desired magnitude $I_{SET}$ over time (indicated with square hatching in the graph of FIG. 5).

Returning to the method 400, after setting the PWM generator 225 to operate the switch Q1 as described, the controller 115 enters into a sleep mode (block 412) during which time the controller uses a minimal amount of power from the power supply 230. During the sleep mode, the modulating operation of the switch Q1 at step 415 continues.

The method 400 may be repeated at intervals, so that the modulation duty cycle can be updated to account for changes in the shorted anode current that might result from degradation of the glass lining of the tank 105, changes in water conductivity, reduction of anode surface area, and other factors. The method 400 may be performed by the controller 115 at a set frequency. In some embodiments, the method 400 occurs once a week, but in other embodiments the method 400 occurs more often or less often. This set frequency may be stored in memory 205 and may be adjusted by a user input. Each time the shorted anode current of the sacrificial anode 120 is measured, the modulation duty cycle of the operating current may be adjusted. Between performances of method 400, the controller 115 remains in the sleep mode in which the controller 115 only keeps the PWM generator 225 active, preserving the charge of the power supply 230.

The inventors have found that operating the sacrificial anode 120 by the wave form method 400 will provide cathodic protection of the tank 105, while simultaneously extending the life of the sacrificial anode 120 to be approximately equal to the life of the anode with a constant current equal to $I_{SET}$. The sacrificial anode 120 will be consumed at a rate that is essentially proportional to the time integral of the anode current. As described above with respect to the graph of FIG. 5, by operating the anode as described, this will be equivalent to the rate at an anode operating with the constant current $I_{SET}$ would be consumed. In contrast, a sacrificial anode operating without the benefit of the anode control method 400 in a high conductivity water environment would degrade substantially faster. By way of example, if the shorted anode current $I_{SHORT}$ were to be twice the magnitude of the desired current $I_{SET}$, then the duty cycle would be equal to 50% and the expected life of the sacrificial anode would be doubled. In some high conductivity water installations the life of the sacrificial anode can be extended by many multiples.

The method 400 allows for sacrificial anode control without requiring high power consumption. As a result, the controller 115 and the associated method 400 is especially well-suited for water heaters that are installed in locations where access to electrical power is not readily available. By way of example, residential, atmospherically vented, combustion water heaters are frequently installed in basement locations that lack a nearby power outlet. Since the controller 115 is in a sleep mode for the vast majority of the time, and the PWM operation does not require high power consumption, the power supply 230 can in some embodiments be provided by a power source that has a limited amount of energy available. In some embodiments, the average current draw of the controller 115 operating the method is no greater than 30 mA. Such embodiments can be powered by batteries (for example, AA-size cylindrical alkaline batteries) having a capacity of around 2700 mAH for a period of ten years.

As operation continues over time, the power supply 230 may discharge completely. Accordingly, during the life of the water heater 100 the controller 115 may be unable to continue to perform method 400 as the power supply 230 discharges below a power threshold. The anode control circuit 300 is configured so that the anode control processor 220 maintains the second switch Q2 in an open position while power is being supplied by the power supply 230. In response to the power supply 230 discharging below the power threshold, the second switch Q2 moves to an ON or closed position to create an electrical short between the sacrificial anode 120 and the tank 105. Accordingly, the shorted anode current will be present between the sacrificial anode 120 and the tank 105 when the power supply 230 is discharged, so that the sacrificial anode 120 will continue to provide cathodic protection of the tank 105. In some embodiments, the controller 115 can include hardware in series with the second switch Q2 to provide an indication that the power supply 230 is discharged. The indication may be an audio indication, such as an alarm, or a visual indication, such as turning on an LED.

Thus, the application provides, among other things, a system and method for controlling current to a sacrificial anode. Various features and advantages of the application are set forth in the following claims.

What is claimed is:

1. A water heater comprising:

a tank to contain a fluid;

a sacrificial anode protecting the tank from corrosion; and a controller coupled to the sacrificial anode and configured to:

selectively complete and break an electrical circuit connecting the tank and the sacrificial anode, wherein the electrical circuit includes a resistor;

measure a shorted anode current through the electrical circuit by measuring a voltage drop across the resistor;

determine a modulation duty cycle based on a current setpoint and the measured shorted anode current; and repeatedly complete and break the electrical circuit using the modulation duty cycle.

2. The water heater of claim 1, wherein the controller includes a switch and wherein the controller is configured to complete and break the electrical circuit by closing and opening the switch.

3. The water heater of claim 2, wherein the controller further includes a resistor arranged in series with the switch and wherein the controller is configured to measure the shorted anode current by measuring a voltage drop across the resistor.

4. The water heater of claim 2, wherein the switch is a first switch and wherein the controller includes a second switch arranged electrically in parallel with the first switch.

5. The water heater of claim 4, wherein the second switch is in a closed configuration in the absence of power being supplied to the controller and is in an open configuration while power is supplied to the controller.

6. The water heater of claim 1, wherein the controller is configured to measure the shorted anode current at a set frequency.

7. The water heater of claim 6, wherein the modulation duty cycle is adjusted based on each measurement of the nominal current.

8. The water heater of claim 1, wherein the controller is configured to complete and break the electrical circuit using pulse width modulation at a frequency of at least 1 kHz.

9. The water heater of claim 8, wherein the pulse width modulation frequency is between 30 kHz and 140 kHz.

10. The water heater of claim 1, wherein the controller includes a power source comprising a battery.

11. A method for controlling a sacrificial anode for a tank containing an electrolytic fluid, the method comprising:

measuring a shorted anode current through the sacrificial anode and the tank;

determining a modulation duty cycle based on a current setpoint and the measured shorted anode current; and completing and breaking an electrical circuit connecting the sacrificial anode and the tank using the modulation duty cycle, wherein the modulation duty cycle is determined such that an integral over a period of time of the current flow resulting from making and breaking the electrical circuit connecting the sacrificial anode and the tank using the modulation duty cycle is equivalent to the current setpoint multiplied by said period of time.

12. The method of claim 11, further comprising completing and breaking the electrical circuit using pulse width modulation at a frequency of at least 1 kHz.

13. The method of claim 12, wherein the pulse width modulation frequency is between 30 kHz and 140 kHz.

14. The method of claim 12, wherein completing and breaking the electrical circuit that connects the sacrificial anode and the tank includes applying an operating current to the sacrificial anode using the pulse width modulated frequency at a frequency defined by the pulse width modulated frequency.

15. The method of claim 11, further comprising measuring the shorted anode current at a set frequency.

16. The method of claim 15, wherein the modulation duty cycle is adjusted based on each measurement of the shorted anode current.

17. The method of claim 11, wherein measuring the shorted anode current comprises:

turning on a switch in order to complete the electrical circuit; and measuring a voltage drop across a resistor arranged in series with the switch.

18. A method for controlling a sacrificial anode for a tank containing an electrolytic fluid comprising operating in a first mode when power is available to a controller for the sacrificial anode and in a second mode when power is not available to the controller, wherein operating in the first mode includes selectively opening and closing a first switch to regulate an average current flow between the sacrificial anode and the tank and wherein operating in the second mode includes allowing a second switch to close in order to allow a constant current flow between the sacrificial anode and the tank.

19. The method of claim 18, wherein operating in the first mode requires no more than 30 mA of average current draw by the controller.

* * * * *